US010399807B2

(12) United States Patent
Merdinger

(10) Patent No.: US 10,399,807 B2
(45) Date of Patent: Sep. 3, 2019

(54) APPARATUS FOR CONTROLLING THE SCROLL OF A TORAH PARCHMENT SHEET

(71) Applicant: HAZORFIM LTD, D.N. (IL)

(72) Inventor: Yakov Merdinger, Tel Aviv (IL)

(73) Assignee: HAZORFIM LTD, D.N., Kfar Daneil (IL)

( * ) Notice: Subject to any disclaimer, the term of this patent is extended or adjusted under 35 U.S.C. 154(b) by 354 days.

(21) Appl. No.: 15/243,995

(22) Filed: Aug. 23, 2016

(65) Prior Publication Data

US 2017/0057769 A1 Mar. 2, 2017

Related U.S. Application Data

(60) Provisional application No. 62/211,804, filed on Aug. 30, 2015.

(51) Int. Cl.

| | |
|---|---|
| ***B42D 15/00*** | (2006.01) |
| ***B65H 16/00*** | (2006.01) |
| ***B65H 18/08*** | (2006.01) |
| ***B65H 18/10*** | (2006.01) |

(52) U.S. Cl.

CPC ..... *B65H 18/103* (2013.01); *B42D 15/0093* (2013.01); *B65H 16/005* (2013.01); *B65H 18/085* (2013.01); *B65H 2301/4493* (2013.01); *B65H 2402/542* (2013.01); *B65H 2403/47* (2013.01)

(58) Field of Classification Search

CPC .. B65H 18/103; B65H 16/005; B65H 18/085; B65H 2403/47; B65H 2402/542; B65H 2301/4493; B42D 15/0093

See application file for complete search history.

(56) References Cited

U.S. PATENT DOCUMENTS

| | | | | |
|---|---|---|---|---|
| 1,913,176 | A * | 6/1933 | Twiss | G01D 15/24 242/375 |
| 2,438,887 | A * | 4/1948 | Allen | B41J 11/24 242/421.8 |
| 2,823,859 | A * | 2/1958 | Stock | G06G 1/04 235/71 R |
| 6,581,869 | B2 * | 6/2003 | Arrane | G09B 29/06 242/533.8 |
| 2004/0257301 | A1 * | 12/2004 | Ari | B42D 19/005 345/30 |
| 2006/0022081 | A1 * | 2/2006 | Puffer, Jr. | B65H 16/06 242/523 |

(Continued)

OTHER PUBLICATIONS

The Gelilah Star Patent http://en.tiktorah.com/category/our-patent.

*Primary Examiner* — William A. Rivera
(74) *Attorney, Agent, or Firm* — Soroker Agmon Nordman

(57) ABSTRACT

The subject matter discloses a control mechanism for a scrolling of a Torah parchment in a Torah scroll case, comprising an internal handle located inside a Torah scroll case, mounted on a pole on which the parchment is rolled an external cogwheel located outside of the Torah scroll case, mounted on a pole on which the parchment is rolled, rotation of the external cogwheel results in rotation of the pole; and, a springy unit pressed towards a niche in said external cogwheels utilized to control the movement of the pole on which the parchment is rolled.

15 Claims, 7 Drawing Sheets

(56) References Cited

U.S. PATENT DOCUMENTS

| | | | | |
|---|---|---|---|---|
| 2007/0195514 | A1* | 8/2007 | Katz | G09F 11/29 362/97.1 |
| 2008/0308666 | A1* | 12/2008 | Cowdrey | G09F 11/21 242/528 |
| 2016/0145068 | A1* | 5/2016 | Goldknopf | B65H 75/42 242/598.5 |

* cited by examiner

APPARATUS FOR CONTROLLING THE SCROLL OF A TORAH PARCHMENT SHEET

FIELD OF THE INVENTION

The present invention generally relates to the field of scrolling a Torah parchment sheet, more specifically to the field of scrolling a Torah parchment contained in a Torah scroll case.

BACKGROUND OF THE INVENTION

The Torah scroll plays a central role in the Jewish religion custom, and in the synagogue activities as a part of the prayers. In the synagogue, the Torah reader is required to concentrate at the Hebrew text in order to read it loudly to the entire assembled audience while utilizing a correct word pronunciation. The reading of the holy text should be performed with the right pronunciation and the correct musical tones, in similar fashion as musicians use musical notes. The Torah text is considered as a holy text for those who belong to the Jewish religion and therefore cannot be replaced or copied. Furthermore, adding signs, notes, marks or text to the Torah scroll is absolutely forbidden. In multiple cases, the Torah scroll reader who stands and reads, needs a steady place which can host the Torah scroll, an ability to freely scroll the parchment on the Torah scroll, and an option to stabilize the Torah parchment for the purpose of accurate reading. In cases of the Torah parchment reading, especially at the beginning or at the end of the reading, most of parchment is rolled-up on one side and wraps up one of the poles of the Torah scroll. For example, at the beginning of the Jewish year which also known as Rosh Hashanah, the Torah readers read the first portions of the old testament and most of the parchment is rolled-up on one side. In such cases, the Torah reader may have a challenge roll up the parchment during the reading while stabilizing the parchment at the desirable page. In some other cases, especially on Sabbath, other people from the assembled audience in the synagogue are "called to the Torah" in order to take part in the reading. In this situation, multiple readers may swap rapidly while the rest of the audience expects a fluent and continuously reading of the holy text. This situation emphasizes the need for both of the characteristics, an option to scroll the parchment rapidly and an option to stabilize the parchment, once the person who scrolls the parchment has reached the desirable portion in the parchment.

SUMMARY OF THE INVENTION

The present invention discloses a control mechanism for a parchment scrolling in a Torah scroll case. The Torah scroll case may be the cylinder-shaped case which houses the Torah scroll and be opened to two half-cylinder case parts which contain portions of the Torah parchment. The control mechanism for a parchment scrolling comprises an internal cogwheel located inside the Torah scroll case and mounted on a pole on which the parchment is rolled. The control mechanism also comprises an external cogwheel located outside of the Torah scroll case and also mounted on the pole on which the parchment is rolled. The control mechanism further comprises a springy unit located outside of the Torah and used to control the movement of the external cogwheel. The springy unit comprises a round shaped protuberant unit that can be pressed against the external cogwheel and be resided between the teeth of the external cogwheel. The springy unit may have at least two control states to control the rotation of the external cogwheel, one state may allow a rotation of the external cogwheel and one state may lock the external cogwheel in order to prevent the scrolling of the Torah parchment. The lock state may be achieved by locking the protuberant unit and prevent it from moving away from the external cogwheel. For example, a user can use the springy unit to lock the movement of the protuberant unit. Thus, the protuberant unit may remain pressed against the external cogwheel, between the teeth of the external cogwheel and thereby prevent the rotation of the external wheel and rolling of the Torah parchment.

The Torah scroll case may be a cylinder shaped case which can open to two half-cylinder parts. In some cases, the half-cylinder parts may be connected by hinges which allow opening of the Torah scroll case to form two half-cylinders connected to each other in one side and allow a user to roll the parchment from one half cylinder to the other. The control mechanism is also designed to be used for scrolling the Torah parchment when the Torah scroll case is closed. For example, a user can close the two half-cylinder parts, rotate the external cogwheel located outside of the Torah scroll, and thereby roll the parchment located within the closed Torah scroll case. The internal cogwheels are designed to facilitate the rolling movement of the Torah parchment when the Torah scroll case is open. Thus, a user which handles the scrolling may rotate one of the internal cogwheels and thereby roll the parchment on the pole on which the internal cogwheel is mounted. The diameter of the internal cogwheels may be larger than the diameter of the fully rolled up parchment, in order to allow free rolling movement. Thus, the internal cogwheels in each side of the Torah scroll case, may be placed in a different height on the pole of the Torah scroll ease in order to allow a full closing of the Torah scroll case.

BRIEF DESCRIPTION OF THE DRAWINGS

Some embodiments of the invention are herein described, by way of example only, with reference to the accompanying drawings. With specific reference now to the drawings in detail, it is stressed that the particulars shown are by way of example and for purposes of illustrative discussion of embodiments of the invention. In this regard, the description taken with the drawings makes apparent to those skilled in the art how embodiments of the invention may be practiced.

In the drawings.

DETAILED DESCRIPTION OF THE INVENTION

The present invention discloses a control mechanism for scrolling in a Torah parchment within a Torah scroll case. The control mechanism comprises an external cogwheel connected to a pole of the Torah scroll case utilized to contain the rolled sheet of the Torah parchment. The control mechanism also comprises a springy unit attached to the external cogwheel case which can break down the scrolling movement to small movements or, in some other cases, to block the scrolling movement of the Torah parchment. For example, the Torah parchment can be rolled rightward or leftward, as required by the person who handles the scrolling. The springy unit may break down the scrolling movement to short movements till the desired Torah parchment sheet is reached, and then, the user who handles the scrolling can lock the springy unit and thereby to prevent the Torah scroll from scrolling further. The person who handles the scrolling can then read the Torah parchment page, show it, or use it as he or she may want. Then, the user may unlock the springy unit and continue with the scrolling.

In some embodiments of the present invention the Torah parchment may comprise two control mechanisms, one on each case part at the Torah scroll case. The part may be shaped as a half cylinder. Thus, the user who handles the scrolling can lock the left control mechanism and the right control mechanism separately. In some other cases, the user who handles the scrolling may lock only one of the control mechanisms. In some other embodiments of the present invention the Torah case may comprise a single control mechanism in each of the case parts. For example, the control mechanism may be placed in the right side of the Torah scroll case, and a user who handles the scrolling may lock only the right side. Similarity, the control mechanism may be placed in the left side of the Torah control case and said user may lock only the left side of the Torah mechanism.

The cogwheels of the control mechanism control the fashion in which the Torah parchment is moved between the two case parts of the Torah scroll case. For example, in case the Torah parchment is moved from left to right the cogwheel of the right control mechanism may be used to control the scrolling. In case the Torah parchment is moved from right to left, the cogwheel of the left control mechanism may be used to control the scrolling. Once the scrolling movement has completed, the springy unit can be used to lock the control mechanism, and thereby lock the rotation movement of the poles and hence the scroll of the Torah Parchment.

Figure 1:
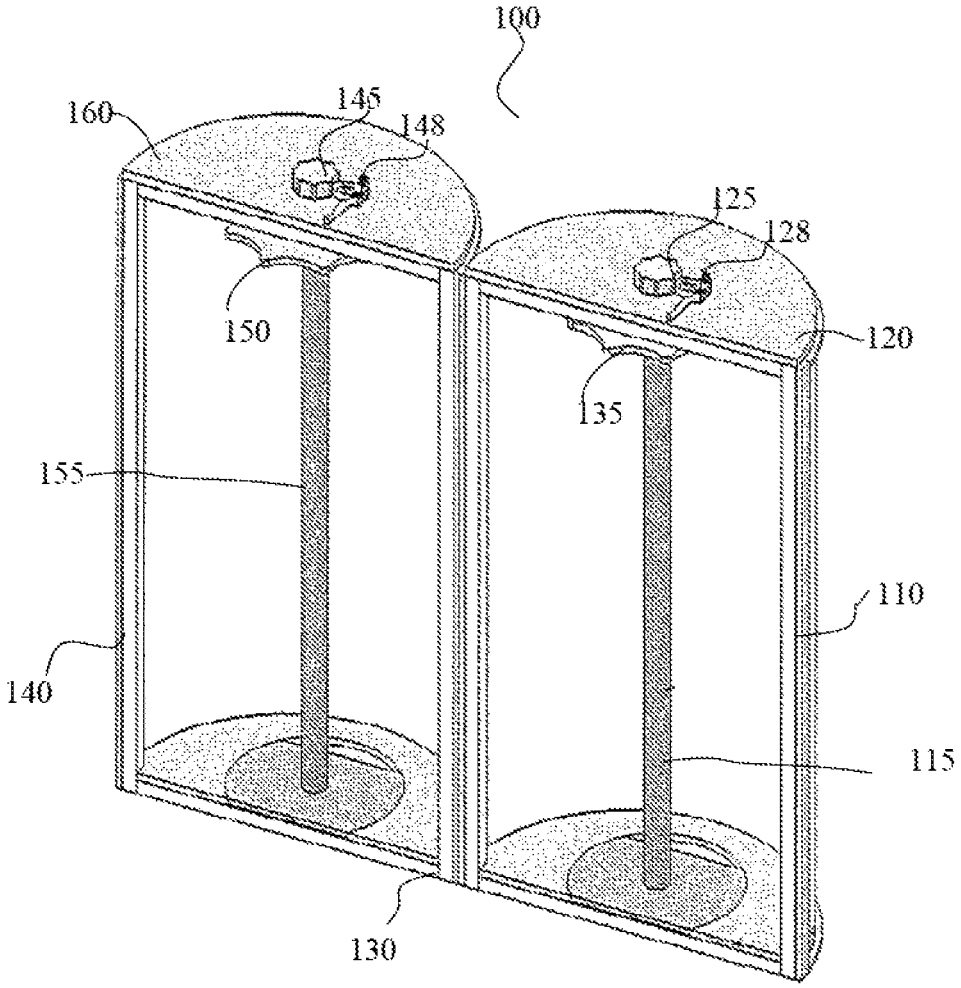
FIG. 1 shows a Torah scroll case having two half-cylinder case parts and two control mechanisms, in accordance with exemplary embodiments of the disclosed subject matter.

FIG. 1 shows a Torah scroll case having two half-cylinder case parts and two control mechanisms, in accordance with exemplary embodiments of the disclosed subject matter. The Torah scroll case 100 comprises two half-cylinder case parts, right half-cylinder part 110 and left half-cylinder part 140. A portion of the Torah Parchment sheet is contained in each side of the Torah scroll case 100. Torah scroll case 100 also comprises two poles, pole 115 and pole 155 on which the Torah parchment sheet is up rolled around. The poles 115 and 155 are vertical in nature, and extend from the inner top of the half-cylinder parts 110, 140 to the bottom. For example, in case the Torah parchment is rolled from left to right, the Torah parchment sheet may be rolled around pole 115. In case the Torah parchment is rolled from right to left, the Torah parchment sheet may be rolled around pole 155. The poles 115 and 155 comprise upper ends and lower ends, the lower ends are connected to the bottom 130 of the Torah scroll case. The u pole 115 may be connected to an internal handle 135 that maneuvers the pole 115 and enables scrolling of the Torah parchment. Similarity, the pole 155 may be connected to internal handle 150 that maneuvers the pole 155. The internal handle 135 may be connected to an upper cogwheel 125 located above the top 120 of the Torah scroll case 100. The internal handle 155 may be connected to an upper cogwheel 145 located at the outer side of the Torah scroll case 100, above the top 160.

The cogwheel 125 may be located in close proximity with to a springy unit 128 located above the top 120 of the Torah scroll case 100. The springy unit 128 may comprise a protuberant wheel such that the springy unit 128 knocks on each segment between the teeth of the upper cogwheel 125 when steering the pole 115. This way, the user of the Torah scroll case 100 may count the number of clicks in order to estimate how much the pole 115 was steered, and therefore estimate how much of the Torah Parchment sheet was rolled around pole 115.

Figure 2:
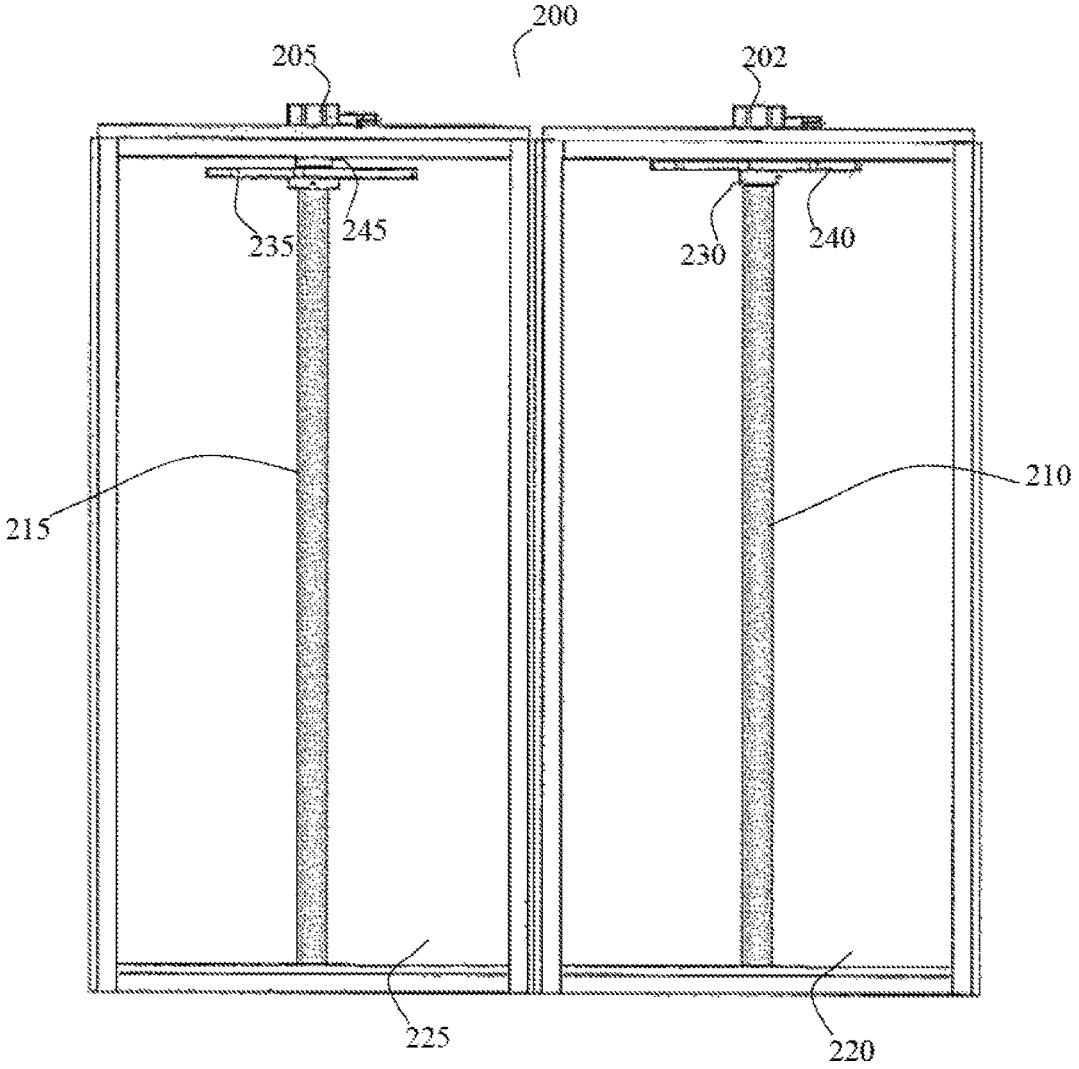
FIG. 2 shows a lateral view of a Torah scroll case having two half-cylinder case parts for housing the Torah parchment, in accordance with exemplary embodiments of the disclosed subject matter.

FIG. 2 shows a lateral view of a Torah scroll case having two half-cylinder case parts for housing the Torah parchment, in accordance with exemplary embodiments of the disclosed subject matter. The Torah scroll case 200 comprises a right half-cylinder part 220 and a left half-cylinder part 225 in which the Torah Parchment sheet is contained. The right half-cylinder case 220 comprises a right pole 210 around which a first portion of the Torah parchment sheet is rolled after reading, by the user of the Torah scroll case 200. Similarly, the left half-cylinder part 225 comprises a left pole 215 around which the second portion of the Torah Parchment sheet is rolled after reading. The right pole 210 and the left pole 215 are maneuvered, for example turned clockwise, using control mechanisms located outside the Torah scroll case 200.

The control mechanism may comprise an internal handle 240 connected to the control mechanism via an internal step 230. Internal handle 240 is designed to allow free scrolling movement of the Torah parchment. For example, a user can use internal handle 240 to freely scroll the parchment rightward of leftward. FIG. 2 also shows the internal handle 230 which is connected to the external cogwheel 202 located outside the Torah scroll case 200. For example, via a connection rod (not shown), which may be an extension of pole 210. In the right Torah half-cylinder part 220, the internal step 230 is mounted around the pole 210, beneath the internal handle 240. The diameter of the internal handle 240 is significantly wider than the diameter of the internal step 230, as both the internal step 230 and the internal cogwheel 240 are concentric.

In the left half-cylinder case part 225, the left pole 215 is connected to the internal handle 235, which is connected to the internal step 245. The internal handle 245 is mounted on pole 215 above the internal handle 235 in a similar fashion as internal handle 240 is located above the internal step 230. As a result, the internal handle 235 is placed higher than the internal handle 240, such that when closing the Torah scroll case 200, the internal handle 235 and the internal handle 240 do not interfere with one another and the Torah scroll case 200 can be closed completely. The internal handles 240 and 235 are used to rotate the poles 210 and 215, respectively. Since the Torah parchment is contained in each half-cylinder case part during the year. Internal handles 240 and 235 may be designed for scrolling the Torah parchment during the reading.

Figure 3:
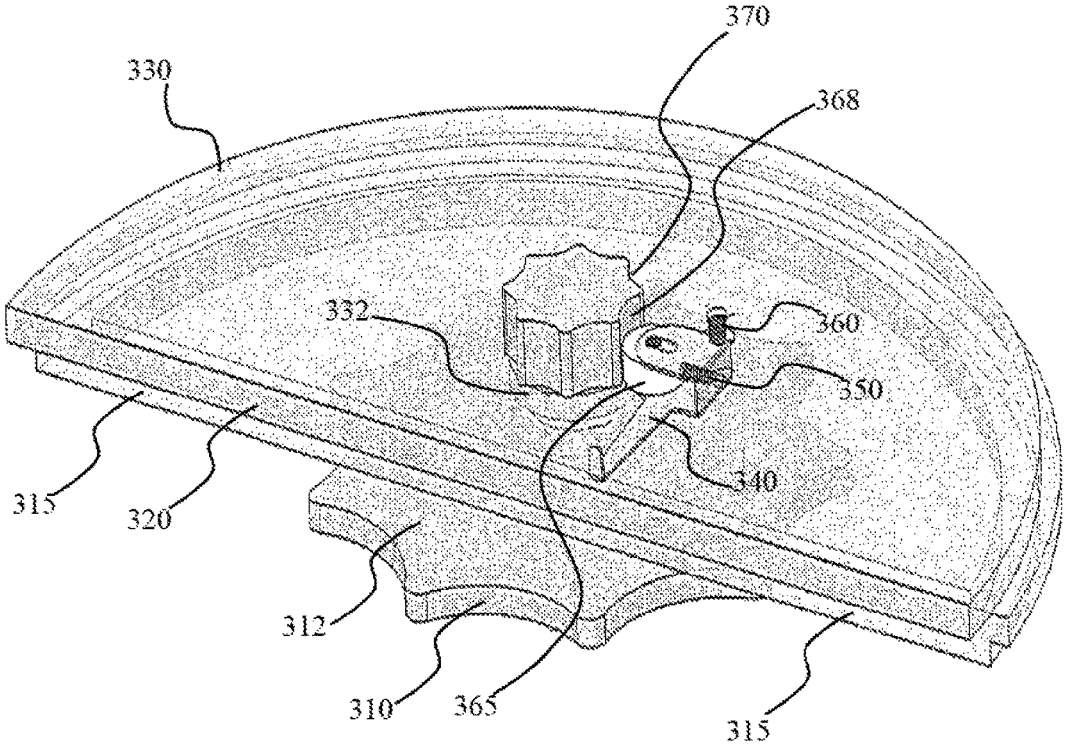
FIG. 3 shows the top of the half-cylinder case and a control mechanism of the Torah parchment scrolling, in accordance with exemplary embodiments of the disclosed subject matter.

FIG. 3 shows the top of the half-cylinder case and a control mechanism of the Torah parchment scrolling, in accordance with exemplary embodiments of the disclosed subject matter. The top of the half-cylinder case comprises an internal cover sheet 315 connected to the internal handle 310 and an external cover sheet 320 connected to the external cogwheel 370. In some exemplary cases, the internal cover sheet 315 and the external cover sheet 320 are assembled as a single sheet. The internal handle 310 is connected to the external cogwheel 370 via a connection rod 332 assembled in the internal cover sheet 315 and the external cover sheet 320, such that every turn of the external cogwheel 370 results in turning the internal handle 310, and stopping the rolling movement of one, stops the rolling movement of the other. For example, in case a person rolls the internal handle 310, the external cogwheel 370 rolls as well, and by stopping the rolling movement of external cogwheel 370, the internal handle 310 stops as well. The external cogwheel 370 is mounted on the top surface 330 of the external cover sheet 320.

The external cogwheel 370 comprises a plurality of niches, such as niche 368, located between the teeth of the cogwheel in which the protruding unit 365 is inserted. The user of the Torah scroll case can maneuver the external cogwheel 370 manually and the protruding unit 365 knocks, in every pass of the protruding unit 365 over a cogwheel tooth when moving from one niche to the next niche. The protruding unit 365 can be locked to prevent the user from turning the external cogwheel 370, and thereby preventing the user from rolling the Torah Parchment sheet around the pole connected to the internal handle 310. Locking and unlocking the protruding unit 365 from turning the external cogwheel 370 may be achieved by changing the location of a pin extending upwards from the protruding unit 365 into an aperture as detailed in FIG. 4, said aperture is connected to a handlebar 340 and used to change the status of maneuvering the pole. The protruding unit 365 may be connected to a horizontal spring 350, such that the horizontal spring 350 shrinks when the external cogwheel 370 rotates and pushes the protruding unit 365 towards the horizontal spring 350. In some cases, the mechanism may also comprise a vertical spring 360 for enabling sonic freedom to handlebar 340 when changing the state of the protruding unit, and prevent friction between the handle mechanism and the upper surface of the external cover sheet 320.

In some exemplary cases, the protruding unit 365 is either locked or unlocked, having two states. When locked, the Torah Parchment sheet cannot roll around the pole, and when unlocked, the Torah Parchment sheet can be rolled around the pole. As FIG. 3 exemplifies, locking the protruding unit 365 prevents the external cogwheel 370 from rolling either clockwise or counterclockwise which results in preventing the internal cogwheel 370 from rolling around. In some cases, the protruding unit 365 has at least two states. The first state is locked, the second state is unlocked, in which the external cogwheel touches the protruding unit 365 in every click of the cogwheel 370, and the third state is free, in which the user of the Torah scroll case can roll the handle 310 without touching Torah sheet. In the free state, the user of the Torah scroll case can roll the Torah sheet very quickly around the poles.

Figure 4:
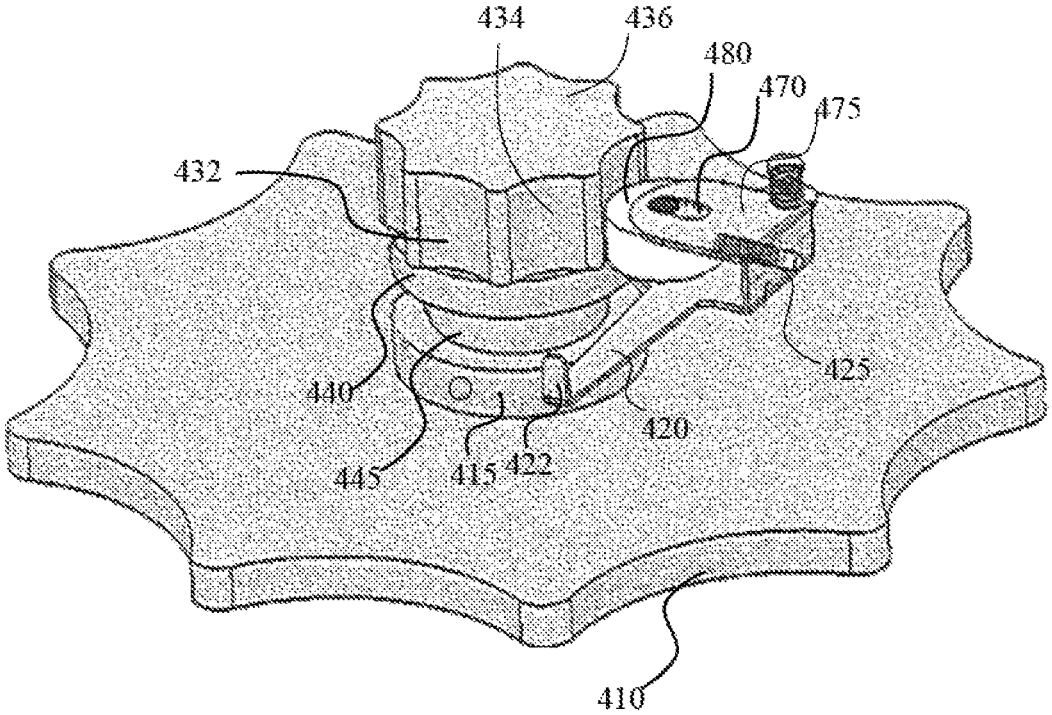
FIG. 4 shows a control mechanism to manage the scrolling of a Torah parchment sheet, in accordance with exemplary embodiments of the disclosed subject matter.

FIG. 4 shows a control mechanism to manage the scrolling of a Torah parchment sheet, in accordance with exemplary embodiments of the disclosed subject matter. The control mechanism comprises an internal handle 410 mounted on the upper end of one of one of the poles in a Torah scroll case, and an external cogwheel 436 which can be maneuvered by a person using the Torah scroll case of the present invention. The internal cogwheel 410 may comprise a step 415 extending upwards from the internal cogwheel 410 to fit higher than the other internal cogwheel located at the other half-cylinder case and prevent the internal cogwheels from interfering with one another. The external cogwheel 436 comprises a plurality of niches such as niches 434, 432 located between the teeth of cogwheel 436, and which come in contact with a protruding unit 480 when the internal handle 410 rotates. For example, in case the user of a Torah scroll case turns the internal handle 410, the turning of internal handle 410 causes to external cogwheel 436 to turn, to the protruding unit 480 to be pressed toward the external cogwheel 436, and be fastened to one of the niches of the external cogwheel 436. The control mechanism further comprises a connection rod 445 used to connect the handle cogwheel 410 and the external cogwheel 436. In some cases, a nut 140 is placed between the external cogwheel 436 and the connection rod 445.

The protruding unit 480 may have two or three states, according to the specific design of the control mechanism. Shifting between the states is achieved by placing a pin extending from the protruding unit 480 in a specific compartment, in an aperture 470, in the handle mechanism 475. As shown in FIG. 4 the handle mechanism 475 is connected to the handlebar 420 with handlebar tip 422. The handle mechanism 475 also comprises horizontal spring 425 that presses the protruding unit 480 toward the external cogwheel 436, when the external cogwheel 436 is maneuvered. For example, horizontal spring 425 in case a user of the Torah scroll case wants to shift the protruding unit 480 from the unlock state to the lock state, the user may hold the handlebar 420 and pull it backwards in order to provide the needed room in aperture 470 for inserting a pin. Once a pin has entered, the horizontal spring 425 presses the protruding unit 480 toward the external wheel 436.

Figure 5:
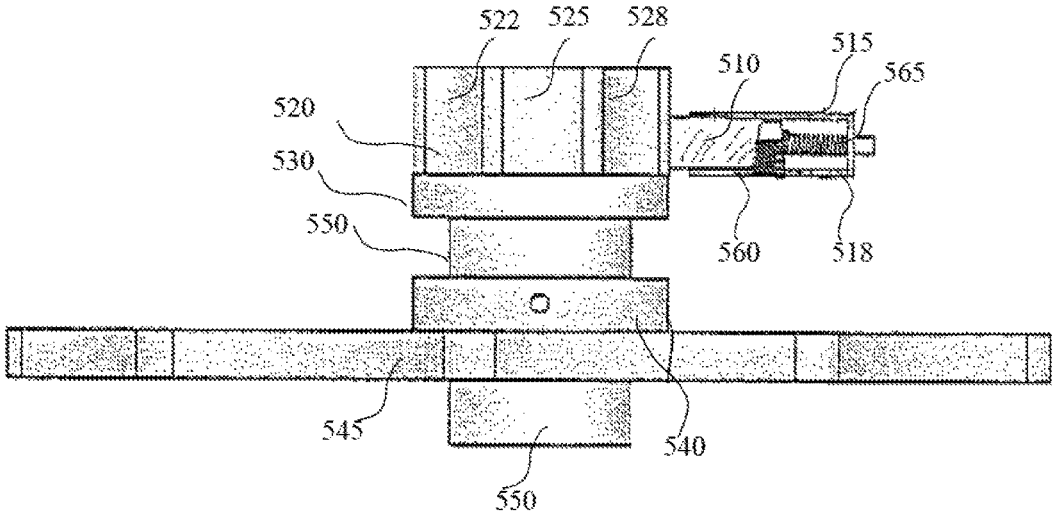
FIG. 5 shows a lateral view of the control mechanism, in accordance with exemplary embodiments of the disclosed subject matter.

FIG. 5 shows a lateral view of the control mechanism, in accordance with exemplary embodiments of the disclosed subject matter. The control mechanism comprises a pole 550 maneuvered by a user using the internal cogwheel as disclosed above. The pole 550 resides inside the half-cylinder case part, and the Torah sheet is rolled around the pole 550. The pole 550 is connected to the internal handle 545 and connected to the external cogwheel 520 via an internal handle 540 in order to consolidate them together to an integrated structure which can move coordinately. For example, when the user who handles the scrolling rotates the internal cogwheel rightwards, or leftwards, the pole 550 turns and causes to external cogwheel 520 to turn. The external cogwheel 520 comprises a plurality of niches, for example niches 522, 525 and 528. The niches are configured to contain the protruding unit 510, which may at least two states. The protruding unit 510 is connected to a handle mechanism 560 defined by a bottom wall 518 and a top wall 515. In some cases, the protruding unit 510 may be pushed inside into one of the niches of external cogwheel 520 by horizontal spring 565. For example, in case the producing unit 510 is in lock state, the protruding unit 510 may be locked, pressed to cogwheel 520, and thereby prevent the rotation of the pole 550. In some other case, when the protruding unit 510 may be in unlock state, the horizontal spring 565 may push the protruding unit 510 into the niches of the external cogwheel 520 and the protruding unit 510 may click upon the turn of pole 550, in every time it being pushed into a niche of external cogwheel 520.

Figure 6:
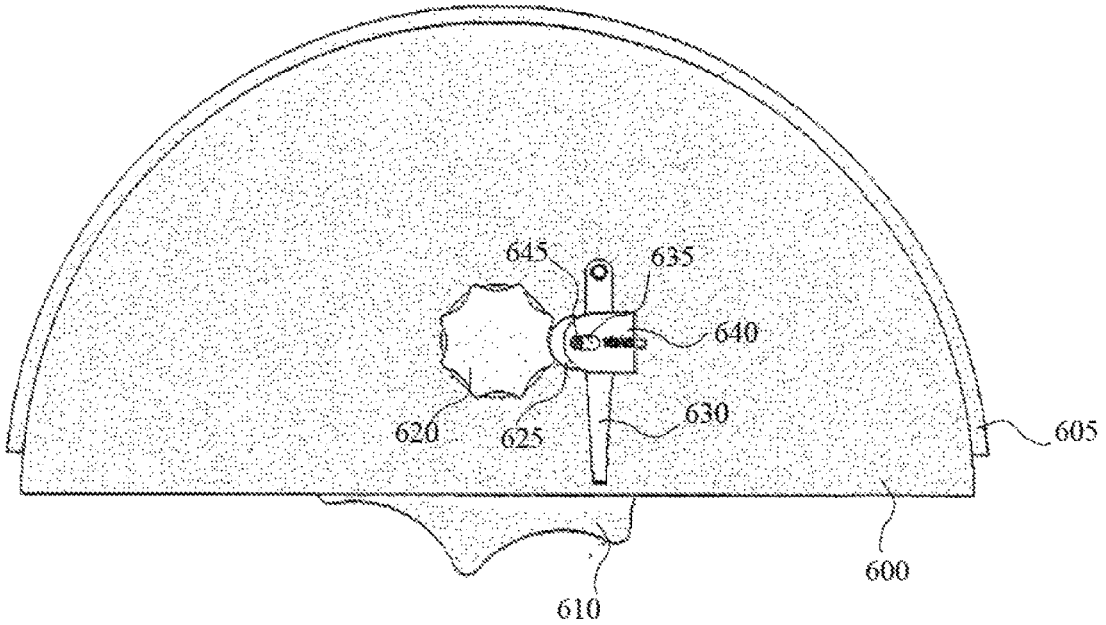
FIG. 6 shows a top view of a Torah scroll case, in accordance with exemplary embodiments of the disclosed subject matter; and, FIG. 7 shows a lateral view of a control mechanism for controlling rolling of a Torah sheet in a cover around a pole, in accordance with exemplary embodiments of the disclosed subject matter.

FIG. 6 shows a top view of a Torah scroll case, in accordance with exemplary embodiments of the disclosed subject matter. The Torah scroll case comprises an upper cover sheet 600 and a lower cover sheet 605. An internal handle 610 is located under, horizontally to the lower cover sheet 605, and inside to Torah scroll case. The external cogwheel 620 is located on top of the upper cover sheet 600, outside the Torah scroll case, and configured to be maneuvered by a user which handles the scrolling of the Torah scroll. The external cogwheel 620 is in contact with protruding unit 625, such that when turning the external cogwheel 620, the protruding unit 625 clicks when touching a niche of the external cogwheel 620. The protruding unit 625 is connected to a handle mechanism 640 such that a bolt 645 extending upwards from the protruding unit 625 is slidable in an aperture 635 in an upper surface of the handle mechanism 640. Sliding the bolt of the protruding unit 625 in the aperture 635 results in changing the state of the control mechanism, for example between lock state, unlock state and free state. The handle mechanism 640 is also connected to a handle 630 used by a user of the Torah scroll case to adjust the position of the bolt in the aperture 635. For example, a user of the Torah scroll can push the handle 630 aside and hold it still, then pull out the bolt 645, while holding the handle 630 in order to prevent handle mechanism 640 from moving. Then, the user may change the position of bolt 645 in order to change the state of protruding unit 625 (i.e. from lock state to free state). Once the bolt 645 is placed in the right position and the user may release the handle 630 and handle mechanism 640 may be configured in a different state. In some embodiment of the disclosed subject matter, bolt 645 may be replaced by a pin which can be pushed in, and pulled out from the aperture 635 and thereby change the states of the handle mechanism 640.

Figure 7:
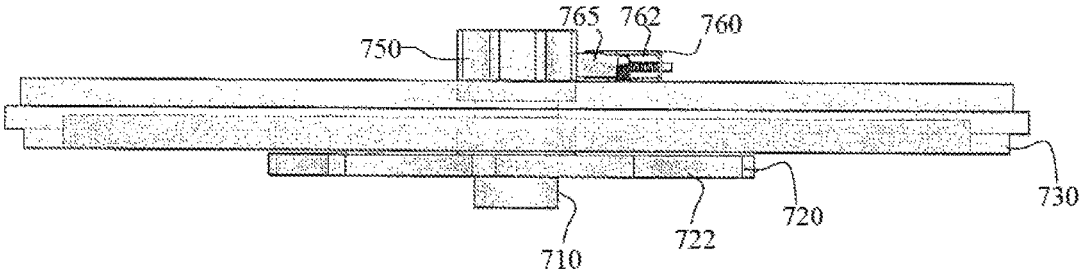

FIG. 7 shows a lateral view of a control mechanism for controlling rolling of a Torah sheet in a cover around a pole, in accordance with exemplary embodiments of the disclosed subject matter. The control mechanism comprises an internal handle 720 connected to a pole 710. The top cover 730 of the cover connects the internal handle 720 and the external cogwheel 750, which is in contact with the protruding unit 765 connected to the handle mechanism 760. The handle mechanism 760 comprises a horizontal spring 762 which pushes the protruding unit 765 forwards after being pushed backwards by the external cogwheel 750 rotations.

The invention claimed is:

1. A control mechanism for a scrolling of a Torah parchment in a Torah scroll case, comprising:

an internal handle located inside a Torah scroll case, mounted on a pole on which the parchment is rolled;

an external cogwheel located outside of the Torah scroll case, mounted on a pole on which the parchment is rolled, rotation of the external cogwheel results in rotation of the pole; and, a springy unit pressed towards a niche in said external cogwheel utilized to control the movement of the pole on which the parchment is rolled;

wherein the Torah scroll case has an open state in which the case is divided into two half-cylinder case parts and a closed state in which the case is of a cylindrical shape;

wherein the control mechanism comprises two control mechanisms, each of the two control mechanisms is attached to one of the two half-cylinder case pans.

2. The control mechanism of claim 1, wherein the internal handle in one half-cylinder case part is located in a different height than the internal handle in the other half-cylinder case part.

3. The control mechanism of claim 1, wherein the external cogwheel is utilized to scroll the parchment located inside the Torah scroll case.

4. The control mechanism of claim 1, wherein the springy unit further comprises a protuberant part pressed against said external cogwheel.

5. The control mechanism of claim 4, wherein the protuberant unit is provided in a wheel shaped part which resides in a space between teeth of said external cogwheel.

6. The control mechanism of claim 4, wherein the protuberant unit has a lock state in which the protuberant unit is locking the external cogwheel from rotating.

7. The control mechanism of claim 6, wherein locking the external cogwheel prevents the Torah parchment from rolling around said poles when the protuberant unit.

8. The control mechanism of claim 4, wherein the protuberant unit has a free state in which the protuberant unit does not touch the external cogwheel.

9. The control mechanism of claim 8, wherein when the protuberant unit is in the free state, the vertical pole allows a free scrolling of the Torah parchment.

10. The control mechanism of claim 4, wherein the protuberant unit has a lock state in which the protuberant unit is locking the external cogwheel from rotating;

wherein the protuberant unit has an unlock state in which the control mechanism external cogwheel is rotatable;

wherein the protuberant unit has a free state in which the protuberant unit does not touch the external cogwheel.

11. The control mechanism of claim 1, wherein the external cogwheel is used to scroll the parchment when the Torah scroll case is closed.

12. A control mechanism for a scrolling of a Torah parchment in a Torah scroll case, comprising:

an internal handle located inside a Torah scroll case, mounted on a pole on which the parchment is rolled;

an external cogwheel located outside of the Torah scroll case, mounted on a pole on which he parchment is rolled, rotation of the external cogwheel results in rotation of the pole; and, a springy unit pressed towards a niche in said external cogwheel utilized to control the movement of the pole on which the parchment is rolled;

wherein the springy unit further comprises a protuberant part pressed against said external cogwheel;

wherein the protuberant unit has an unlock state in which the control mechanism external cogwheel is rotatable;

wherein when the protuberant unit is in the unlock state, the protuberant unit knocks upon the external cogwheel when the external cogwheel rotates.

13. The control mechanism of claim 12, wherein the external cogwheel is used to scroll the parchment when the Torah scroll case is closed.

14. The control mechanism of claim 12, wherein the external cogwheel is utilized to scroll the parchment located inside the Torah scroll case.

15. The control mechanism of claim 12, wherein the springy unit further comprises a protuberant part pressed against said external cogwheel.

* * * * *